US005673996A

United States Patent [19]

Ducker

[11] Patent Number: 5,673,996

[45] Date of Patent: Oct. 7, 1997

[54] PEN WITH LED INDICATOR

[76] Inventor: Douglas W. Ducker, 345 Buckland Hills Dr.-Apt. 8223, Manchester, Conn. 06040

[21] Appl. No.: 712,937

[22] Filed: Sep. 13, 1996

[51] Int. Cl.[6] ..... B43K 29/10

[52] U.S. Cl. ..... 362/118; 362/293; 362/800

[58] Field of Search ..... 362/118, 276, 362/802, 293, 800; 401/195

[56] References Cited

U.S. PATENT DOCUMENTS

| | | | |
|---|---|---|---|
| 2,607,883 | 8/1952 | Berkowitz . | |
| 3,045,111 | 7/1962 | Hoenig . | |
| 3,122,328 | 2/1964 | Weber . | |
| 4,168,521 | 9/1979 | Bajusz . | |
| 4,518,274 | 5/1985 | Hanggi . | |
| 4,737,894 | 4/1988 | Kuch et al. . | |
| 4,883,926 | 11/1989 | Baldwin . | |
| 4,890,204 | 12/1989 | Lin et al. . | |
| 4,964,024 | 10/1990 | Tsay . | |
| 5,131,775 | 7/1992 | Chen . | |
| 5,143,465 | 9/1992 | Hou . | |
| 5,193,897 | 3/1993 | Halsey | 362/118 |
| 5,275,497 | 1/1994 | Shiau . | |
| 5,388,038 | 2/1995 | Yang . | |
| 5,405,208 | 4/1995 | Hsieh . | |
| 5,413,429 | 5/1995 | Shiau . | |
| 5,470,164 | 11/1995 | Chen . | |
| 5,483,429 | 1/1996 | Chu . | |

*Primary Examiner*—Stephen F. Husar

[57] ABSTRACT

A retractable writing instrument such as a pen includes a light assembly in the upper portion of the barrel and a push button to extend and retract the writing tip at its lower end. In the upper portion of the barrel are a battery, a lamp, and a switch which selectively completes or breaks an electrical circuit between the battery and the lamp as a result of movement of the push button. The lamp illuminates a portion of the upper barrel which can serve to highlight advertising indicia on the barrel, or provide an indication of the position of the writing tip, or provide some other special effect.

17 Claims, 4 Drawing Sheets

PEN WITH LED INDICATOR

BACKGROUND OF THE INVENTION

The present invention relates to writing instruments, and, more particularly, to a writing instrument which has a lamp of the position of the tip or for advertising purposes.

Due to their relatively low cost and high utility, writing instruments are commonly used for advertising purposes, by providing a trademark of a product or the name and address of a business along the outer surface of the barrel. In addition, these writing instruments are often designed in a variety of fanciful and artistic forms to enhance their advertising impact or to enable them to be sold as novelty items. However, these advertising or novelty pens do not include electric lamps for enhancing their appearance by illuminating the indicia.

However, electric lamps are widely employed in the lower portion of the barrel of pens to provide illumination of a writing surface in the dark. Moreover, it is common to employ the push button for extending the pen nib as the mechanical actuator of an electric switch for powering the illumination source. The barrels of pens are often specially designed to house the lamps and circuit elements.

A common problem in the use of retractable tip pens is the user's unknowingly placing the pen in a pocket of a shirt or in a purse while the pen nib is extended. This results from the fact that the only indication that the pen tip is extended is given by actually observing the nib extended outwardly of the bottom end of the barrel.

Accordingly, it is an object of the present invention to provide a novel writing instrument with a retractable tip which includes an illumination source in the upper portion of the barrel.

It is also an object to provide such a writing instrument n which a graphic image appearing on the upper portion of the barrel is illuminated.

Another object is to provide such a writing instrument in which the upper portion of the barrel is illuminated when the writing tip is extended.

Still another object is to provide such a writing instrument in which the illumination source is a sub-assembly of relatively simple construction which is easy to install in the barrel of writing instruments of conventional construction.

Yet another object is to provide an illuminated writing instrument which is rugged and long lived and which may be fabricated relatively easily and economically.

SUMMARY OF THE INVENTION

It has now been found that the foregoing and related objects may be readily attained in a retractable writing instrument with a light assembly. The instrument includes an elongated barrel having upper and lower ends with an aperture in the lower end, and writing means having a writing tip at its lower end is disposed within the lower portion of the barrel. Moving means moves the writing means between a first position wherein the writing tip is retracted within the barrel and a second position wherein the writing tip extends outwardly of the aperture in its lower end.

Also included within the upper portion of the barrel are a battery having positive and negative terminals and a lamp for providing illumination of at least a segment of the upper portion. The lamp has a first contact electrically connected to one terminal of the battery and a second contact. Also included is a switch supported in the barrel for selectively effecting the connection of an electrical circuit between the other terminal of the battery and the second contact of the lamp. This switch is operably connected to the moving means and has (i) a switch-off position when the writing means is in the first position and in which the circuit is open to turn off the lamp, and (ii) a switch-on position when the writing means is in the second position and in which the circuit is closed to turn on the lamp.

The moving means may additionally move the writing means into a third position intermediate the first and second positions thereof in which the writing tip is partially extended outwardly of the aperture in the lower end of the barrel. In the third position, the switch is in the switch-off mode and the circuit is open to turn off the lam.

In one embodiment, the upper portion of the barrel has an aperture therein with which the lamp registers when the writing means is in the second position and the circuit is closed to turn on the lamp to provide illumination radially outwardly of the barrel through the aperture.

In another embodiment, the barrel upper portion surrounding the lamp is formed of light transmitting material whereby the lamp provides illumination radially outwardly of the barrel. The barrel upper portion has indicia thereon illuminated by the lamp.

In one embodiment of the light assembly, the lamp and the battery are disposed within a generally cylindrical housing member which is formed of generally light transmitting material and coaxially mounted within the upper portion of the barrel. The switch has contacts on the inner surface of the upper portion of the barrel which are spaced from the first lamp contact and the one battery terminal in the switch-off position. The switch contacts electrically connect the first lamp contact to the one battery terminal in the switch-on position. The barrel upper portion may have a projection on the inner surface thereof, and the switch is mounted in the housing member and includes a lever member projecting radially outwardly of the housing member. The lever member is operable to actuate the switch between the switch-off and the switch-on positions, and the projection engages said lever member when the writing means moves between the first and second positions to move the lever member between the switch-off and the switch-on positions.

Generally, the upper end of the barrel has an aperture therein and wherein the moving means includes a push button slidably seated within the barrel upper portion and extending outwardly of the aperture at the upper end of the barrel. The push button is movable axially to effect the movement of the moving means and the switch between the switch-off and switch-on positions. The barrel is comprised of a pair of generally cylindrical elements and these elements are threadably engaged. For some embodiments, the lamp may emit a colored light and the light corresponds to the color of a mark created by the writing means.

DETAILED DESCRIPTION OF THE PREFERRED EMBODIMENTS

Figure 1:
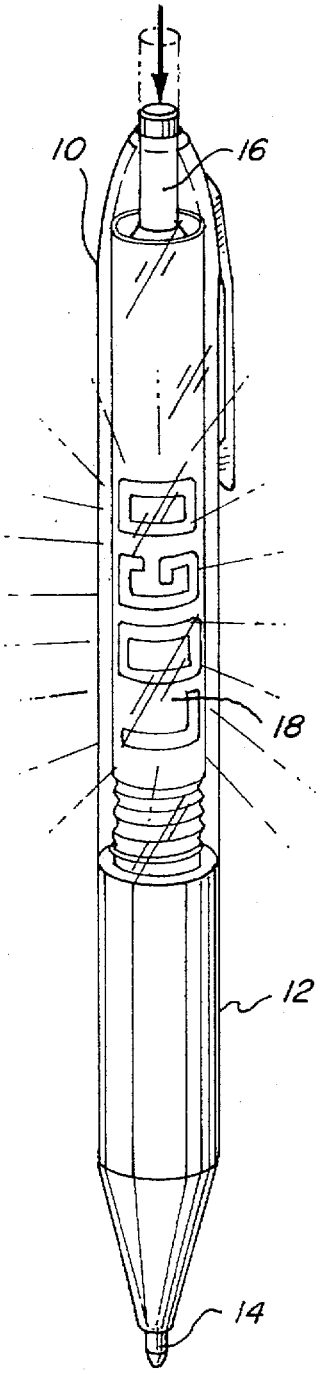
FIG. 1 is a perspective view of a writing instrument embodying the present invention with the upper portion of the barrel illuminated.

Turning first to FIG. 1, therein illustrated is an illuminated pen embodying the present invention and including upper and lower elongated barrel members 10, 12 which are threadably engaged. A pen cartridge 56 (seen in FIG. 6) is disposed within the barrel member 12, and it has a pen nib or tip 14 which extends outwardly of the end of the lower barrel member 12 when the push button 16 at the top of the upper barrel member 10 is depressed. The movement of the push button 16 also mechanically actuates an electric switch 30 (shown in FIG. 2) which illuminates indicia 18 in the upper barrel member 10. The upper barrel member 10 is made from translucent material to permit light to pass therethrough.

Figure 2:
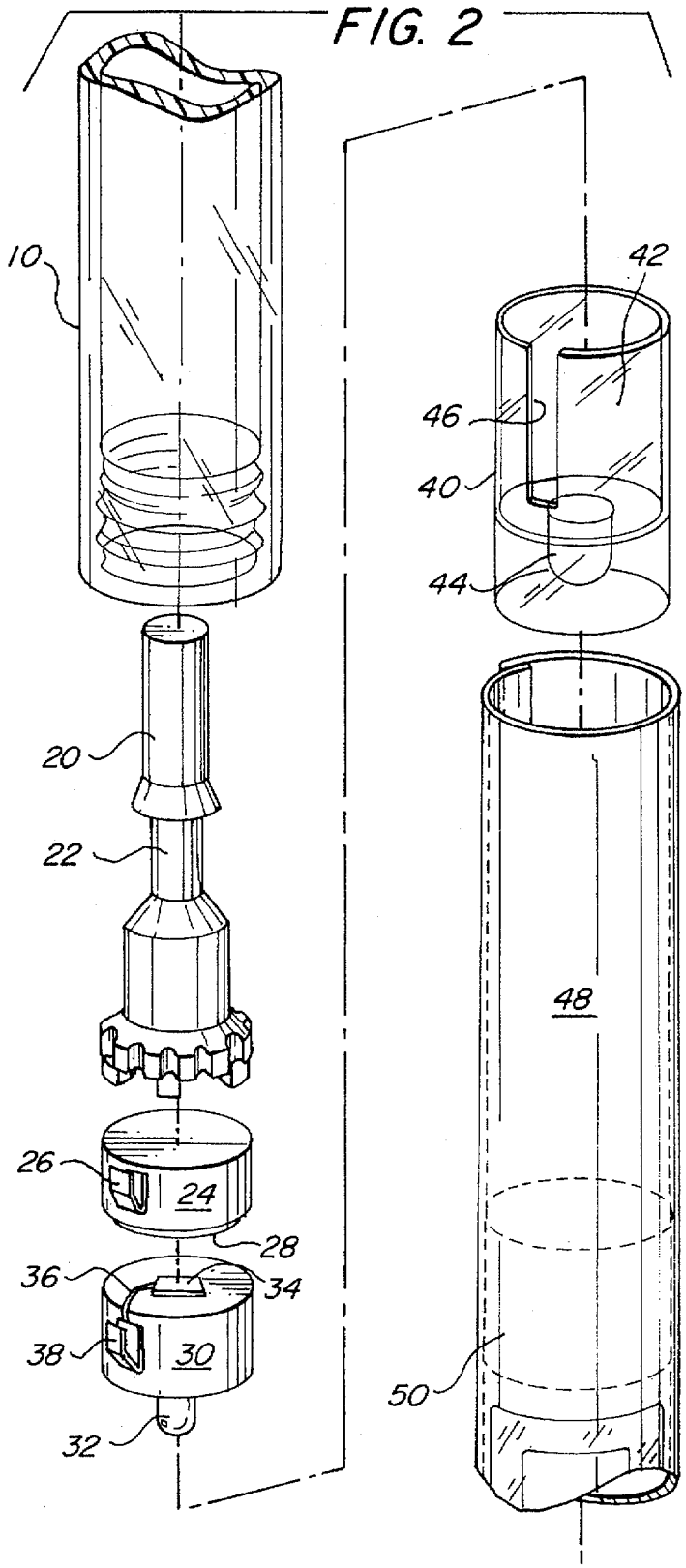
FIG. 2 is a fragmentary exploded view of the writing instrument shown in FIG. 1 and drawn to an enlarged scale.

Turning in detail to FIG. 2, the upper barrel member 10 has slidably mounted within it the push button 16 which comprises a cylindrical cap 20 mounted on the upper end of the elongated plunger 22. Beneath the plunger is a lamp assembly generally indicated by the numeral 23 and comprised of a cylindrical battery 24, a lamp fixture 30 seating a lamp 32 and a translucent cylindrical housing 40 extending thereabout. The battery 24 and lamp fixture 30 are stacked in the cylindrical cavity 42 provided in the upper portion of the housing 40. The LED lamp 32 extends into the small cavity 44 located in the lower end of the housing 40.

The positive terminal 26 of the battery is located along its outer periphery, and the negative terminal 28 is located along its base. The negative terminal 28 of the battery rests on a contact 34 on the upper portion of the lamp fixture 30. The contact 34 in turn is connected by a short wire lead 36 to another contact 38 which is located along the periphery of the cylindrical fixture 30. Both the terminal 26 and the contact 38 are in the form of resilient V-shaped tabs which extend upwardly and radially outwardly from the cylindrical surfaces thereof. The tabs 26, 38 seat within a longitudinally extending slot 46 in the cylindrical housing 40 and extend outwardly thereof.

Figure 3:
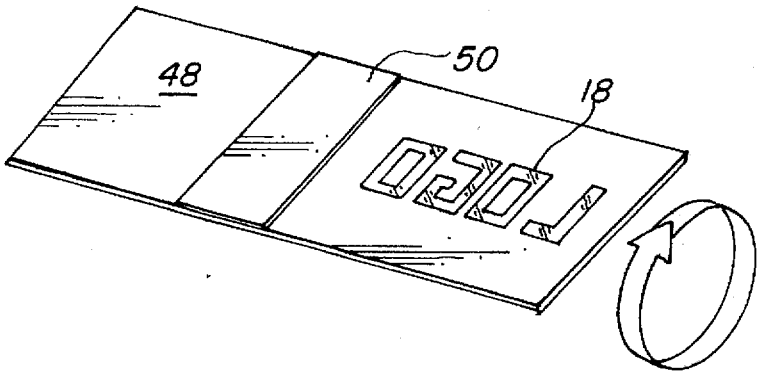
FIG. 3 is a perspective view of the indicia sleeve of the writing instrument of FIG. 1 in its unrolled state and with arrows showing the direction in which the sleeve is rolled.

As seen in FIGS. 2 and 3, a flexible rectangular plastic strip 48 is rolled in the direction of the arrow indicated in FIG. 3 to form an elongated cylindrical sleeve 48. The sleeve 48 is provided with the indicia 18 and with a conductive strip 50 on its inner surface. The indicia 18 are either opaque and bordered by translucent material or translucent and surrounded by opaque material. Moreover, the sleeve 48 or the LED lamp 32 may be colored to indicate the color of the ink in the pen. Except for the conductive strip 50, the sleeve 48 is made from a non-conductive material; it is conveniently formed by plastic sheet material to which a metallic foil is adhered.

Figure 4:
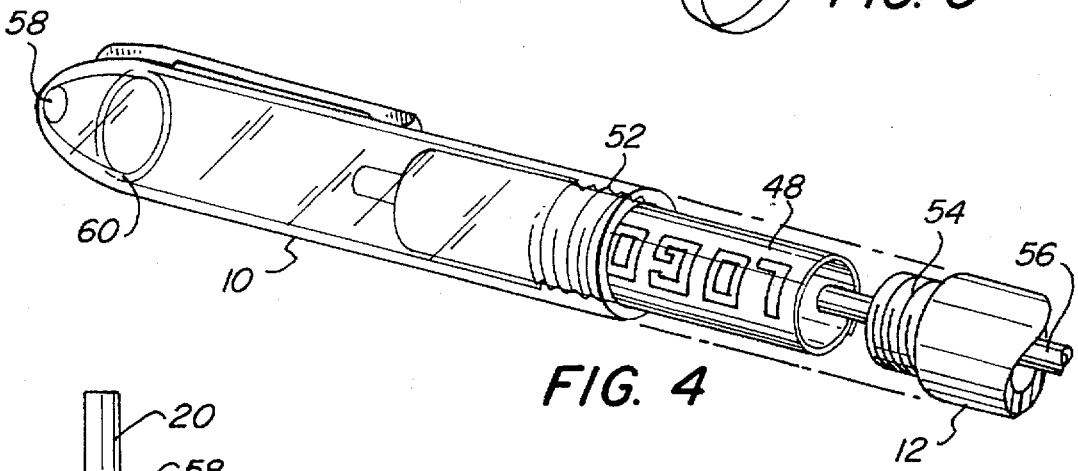
FIG. 4 is a fragmentary perspective view of the upper barrel member of the writing instrument in the process of assembly with the lower barrel member.
Figure 5:
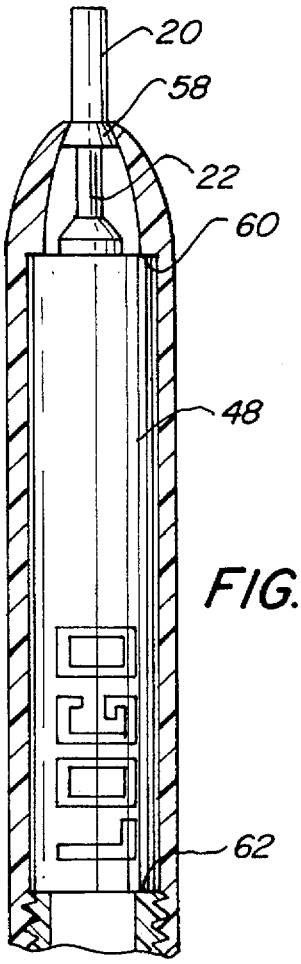
FIG. 5 is a fragmentary vertical view of the upper portion of the writing instrument of FIG. 1 shown in partial section.

In order to assemble the pen, the rolled up sleeve 48 and housing 40 with the push button 16, battery 24, lamp fixture 30 and lamp 32 therein is slid upwardly in the upper barrel member 10 until the sleeve 48 abuts a shoulder 60 adjacent its upper end, as seen in FIGS. 4 and 5. The cap 20 at the top of the push button 16 extends through the aperture 58 at the top of the barrel member 10. As seen in FIG. 5, the lower end of the sleeve 48 abuts the upper end of the lower barrel member 12 at the junction of the barrels 10, 12 which are threadably engaged by internal and external threads 52, 54 respectively. Once assembled, the cap 20 of the push button 16 extends through the aperture 58 located at the upper end of the upper barrel 10.

Figure 6:
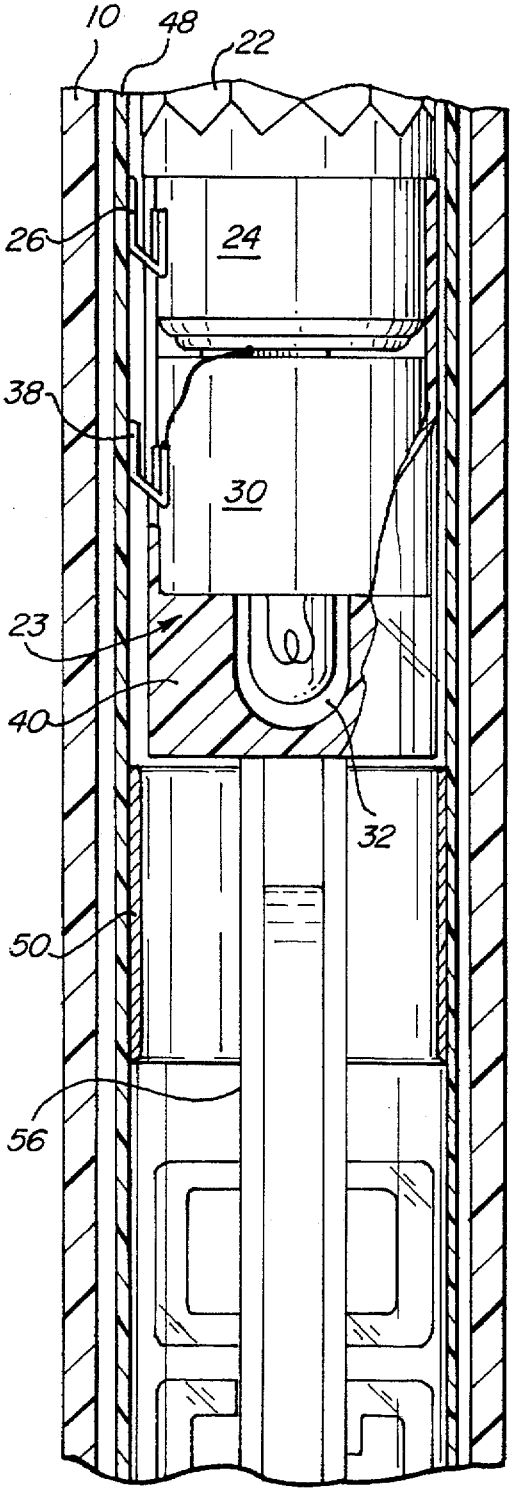
FIG. 6 is a fragmentary vertical cross sectional view of the upper portion writing instrument of FIG. 1 drawn to a greatly enlarged scale.
Figure 7:
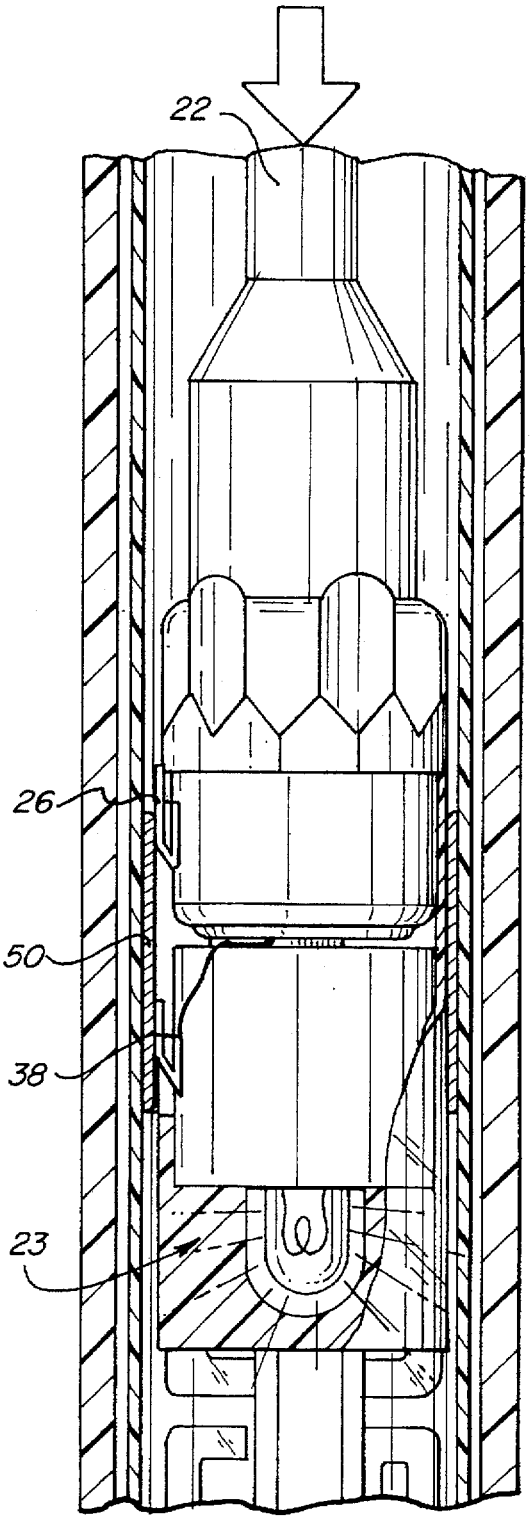
FIG. 7 is a fragmentary cross sectional view similar to FIG. 6 with the lamp illuminated and an arrow indicating the movement of the push button member.

As illustrated in FIGS. 6 and 7, the lower end of the plunger 22 abuts the upper end of the battery 24 and the lower end of the lamp assembly 23 abuts the upper end of the pen cartridge 56. In the position illustrated in FIG. 6, the contacts 26, 38 are displaced from the conductive strip 50 and the lamp 32 is off. When the plunger 22 is depressed as indicated by the arrow in FIG. 7, the contacts 26, 38 travel axially downwardly until they both come in contact with the conductive strip 50, thereby closing the electrical circuit between the battery 24 and lamp fixture 30 to illuminate the lamp 32.

Depending upon the relative position of the conductive strip 50 with respect to the longitudinal travel of the electrical contacts 26, 38, the electrical switch may be closed when the push button 16 is in a variety of positions along the longitudinal axis of the upper barrel member 10. For instance, the relative orientation of the contacts 26, 38 and conductive strip 50 may be such that the electrical circuit is only closed when the push button 16 is fully depressed and is at the lowest portion of its axial travel. This occurs when the pen cartridge 56 is moved between a position in which the pen nib 14 is in its extended position, and a position in which it is retracted. In this arrangement, the electrical switch would normally be closed only for an instant and the lamp 32 would flash on as the push button 16 is fully depressed, and then turn off once the push button 16 is released. This embodiment of the switch of the present invention prolongs battery life and makes the device particularly useful as a novelty item.

In another embodiment, the conductive pad 50 and contacts 26, 38 may be positioned so that the electrical switch is closed when the push button 16 is released and the pen nib 14 is locked in an extended position as shown in FIG. 1. The switch would remain closed and the lamp 32 would remain on until the nib 14 is unlocked and retracted into the lower barrel member 12. This embodiment of the switch of the present invention not only serves well as a novelty item, but also provides an illuminated indication along the upper barrel 10 that the pen nib 14 is extended. This indication, in turn, should serve to remind the user to retract the nib 14 before placing the pen into a pocket or purse.

The lamp assembly with its sleeve 48 is adapted to fit into the upper portion of the barrel of conventional, non-illuminated pens. As a result, custom barrel molds are unnecessary, thereby reducing the cost of producing an illuminated pen in accordance with the present invention.

Figure 10:
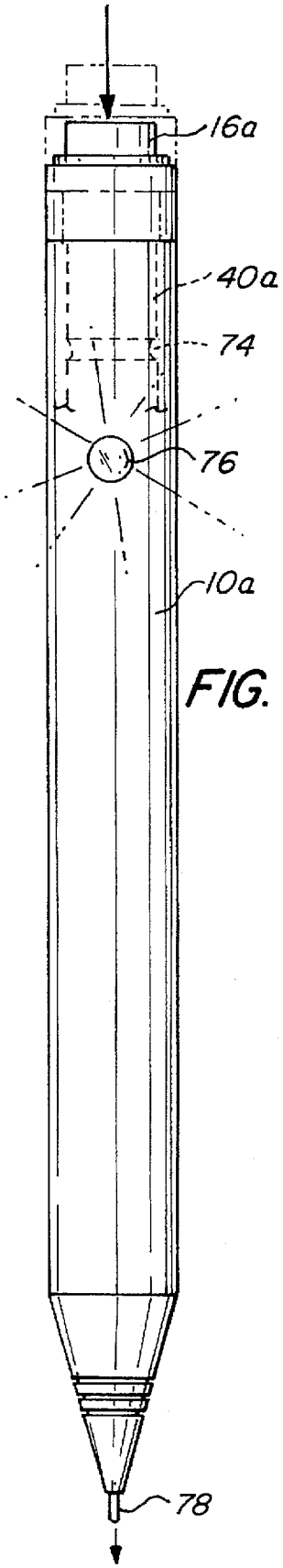
FIG. 10 is a front elevational view of another embodiment of the present invention shown as a pencil which incorporates the lamp assembly of FIG. 8 partially shown in phantom line with an arrow indicating the movement of the push button member.
Figure 8:
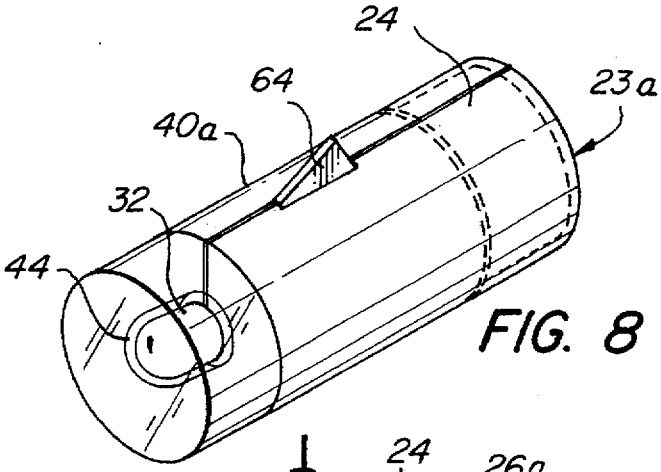
FIG. 8 is a perspective view of another embodiment of a lamp assembly for the writing instrument.
Figure 9:
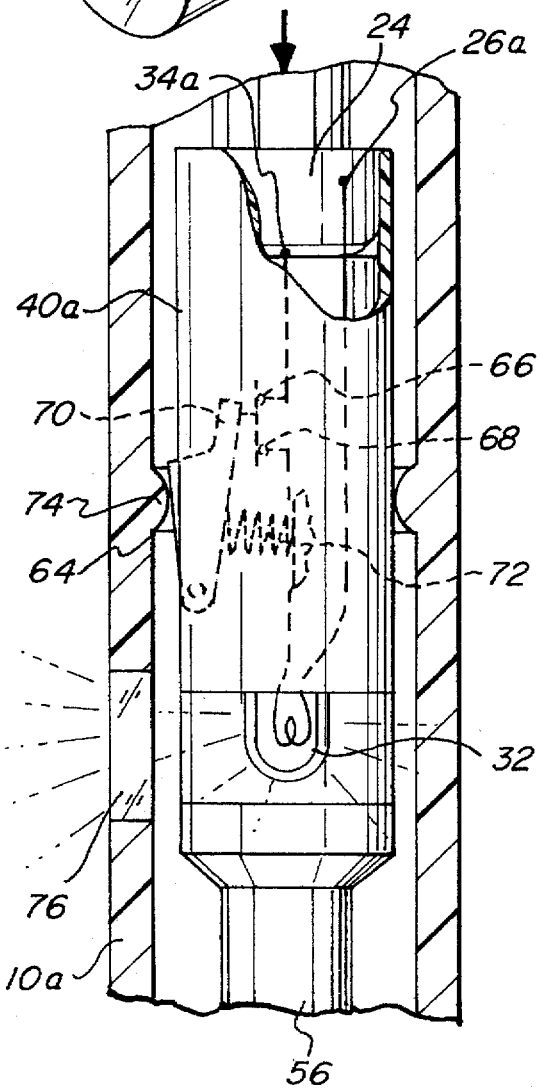
FIG. 9 is a fragmentary vertical cross sectional view of another embodiment of the writing instrument of the present invention incorporating the lamp assembly shown in FIG. 8.

In the embodiment shown in FIGS. 8–10, the sliding electrical switch is replaced by an electrical switch actuated by a lever 64. The cylindrical lamp assembly 23*a* still includes the battery 24, lamp fixture 30 and lamp 32, but it also has a lever 64 extending radially outwardly of the housing 40*a*. The lever 64 has an arm 70 inside the housing 40*a*, and it is biased into an open circuit position by the spring 72. The inner surface of the upper barrel member 10 includes a rib 74 which abuts the lever 64 when the lamp housing 40*a* moves axially in the upper barrel member 10. The lever 64 closes the electrical circuit between the contacts 66 and 68 to turn on the lamp 32. When the lever 64 moves above the rib 74, the spring biases the lever 64 to opens the electrical circuit between contacts 66 and 68 to turn off the lamp 32.

In this embodiment, the writing instrument is a mechanical pencil which extends a pencil lead 78, and the barrel member is an opaque one piece unit. When the lamp 32 is illuminated, it registers with a circular aperture 76 in the side wall of the barrel 10*a*, as illustrated in FIGS. 9–10.

As will be appreciated, various materials may be employed for the construction of the writing instrument and light assembly. Most conveniently, the barrel members and lamp housing are molded from synthetic resin which is relatively inexpensive to mold and durable.

Thus it can be seen from the foregoing detailed description and attached drawings that are illuminated writing instrument of the present invention may illuminate the upper portion of the barrel to indicate when the writing tip is extended, or merely illuminate a graphic image appearing on the upper portion of the barrel for advertising or novelty item purposes.

Having thus described the invention, what is claimed is:

1. A retractable writing instrument with a light assembly comprising:

(a) an elongated barrel having upper and lower ends with an aperture in said lower end;

(b) writing means disposed within the lower portion of said barrel having an upper end and a writing tip at its lower end;

(c) moving means for moving said writing means between a first position wherein said writing tip is retracted within said barrel and a second position wherein said writing tip extends outwardly of said aperture in its lower end;

(d) a battery having positive and negative terminals and disposed within the upper portion of said barrel;

(e) a lamp within said upper portion of said barrel for providing illumination of at least a segment of said upper portion, said lamp having a first contact electrically connected to one terminal of said battery and a second contact;

(f) a switch supported in said barrel for selectively effecting the connection of an electrical circuit between the other terminal of said battery and said second contact of said lamp, said switch being operably connected to said moving means and having (i) a switch-off position when said writing means is in said first position and in which said circuit is open to turn off said lamp, and (ii) a switch-on position when said writing means is in said second position and in which said circuit is closed to turn on said lamp.

2. The writing instrument in accordance with claim 1 wherein said moving means additionally moves said writing means into a third position intermediate said first and second positions thereof in which said writing tip is partially extended outwardly of said aperture in said lower end of said barrel, said switch being in said switch-off mode and said circuit being open to turn off said lamp when said writing means is in said third position.

3. The writing instrument in accordance with claim 1 wherein the upper portion of said barrel has an aperture therein with which said lamp registers when said writing means is in said second position and said circuit is closed to turn on said lamp to provide illumination radially outwardly of said barrel through said aperture.

4. The writing instrument in accordance with claim 3 wherein said lamp emits a colored light and said light corresponds to the color of a mark created by said writing means.

5. The writing instrument in accordance with claim 1 wherein said barrel upper portion surrounding said lamp is formed of light transmitting material whereby said lamp provides illumination radially outwardly of said barrel.

6. The writing instrument in accordance with claim 5 wherein said barrel upper portion has indicia thereon illuminated by said lamp.

7. The writing instrument in accordance with claim 5 wherein said lamp emits a colored light and said light corresponds to the color of a mark created by said writing means.

8. The writing instrument in accordance with claim 5 wherein said lamp and said battery are disposed within a generally cylindrical housing member, said housing member being formed of generally light transmitting material and coaxially mounted within said upper portion of said barrel.

9. The writing instrument in accordance with claim 8 wherein said switch has contacts on the inner surface of said upper portion of said barrel, said contacts being spaced from said first lamp contact and said one battery terminal in said switch-off position, and wherein said switch contacts electrically connect said first lamp contact to said one battery terminal in said switch-on position.

10. The writing instrument in accordance with claim 8 wherein said barrel upper portion includes a projection on the inner surface thereof, said switch being mounted in said housing member and including a lever member projecting radially outwardly of said housing member, said lever member being operable to actuate said switch between said switch-off and said switch-on positions, said projection engaging said lever member when said writing means moves between said first and second positions to move said lever member between said switch-off and said switch-on positions.

11. The writing instrument in accordance with claim 1 wherein said upper end of said barrel has an aperture therein and wherein said moving means includes a push button slidably seated within said barrel upper portion and extending outwardly of said aperture at the upper end of said barrel, said push button being movable axially to effect said movement of said moving means and said switch between said switch-off and switch-on positions.

12. The writing instrument in accordance with claim 1 wherein said barrel is comprised of a pair of generally cylindrical elements.

13. The writing instrument in accordance with claim 12 wherein said cylindrical elements are threadably engaged.

14. A retractable writing instrument with a light assembly comprising:

(a) an elongated barrel having upper and lower ends and apertures in said upper and lower ends, said barrel being comprised of upper and lower cylindrical elements;

(b) writing means disposed within said barrel having an upper end and a writing tip at its lower end;

(c) moving means for moving said writing means between a first position wherein said writing tip is retracted within said barrel and a second position wherein said writing tip extends outwardly of said aperture at its lower end, said moving means including a push button slidably seated within the upper portion of said barrel and extending outwardly of said aperture in the upper end of said barrel;

(d) a battery having positive and negative terminals disposed within said upper cylindrical element;

(e) a lamp within said upper cylindrical element for providing illumination of at least a segment of said upper element, said lamp having a first contact electrically connected to one terminal of said battery and a second contact;

(f) a switch supported in said upper cylindrical element for selectively effecting the connection of an electrical circuit between the other terminal of said battery and said second contact of said lamp, said switch being operably connected to said moving means and having (i) a switch-off position when said writing means is in said first position and in which said circuit is open to turn off said lamp, and (ii) a switch-on position when said writing means is in said second position and in which said circuit is closed to turn on said lamp, said push button being movable axially to effect said movement of said moving means and said switch between said switch-off and switch-on positions.

15. The writing instrument in accordance with claim 14 wherein said moving means additionally moves said writing means into a third position intermediate said first and second positions thereof in which said writing tip is partially extended outwardly of said aperture in said lower end of said barrel, said switch being in said switch-off mode and said circuit being open to turn off said lamp when said writing means is in said third position.

16. The writing instrument in accordance with claim 14 wherein the upper cylindrical element of said barrel has an aperture therein with which said lamp registers with said aperture when said writing means is in said second position and said circuit is closed to turn on said lamp to provide illumination radially outwardly of said barrel through said aperture.

17. The writing instrument in accordance with claim 14 wherein said upper cylindrical element has a portion surrounding said lamp formed of light transmitting material whereby said lamp provides illumination radially outwardly of said barrel.

* * * * *